US007361082B2

(12) United States Patent
Nilsson

(10) Patent No.: US 7,361,082 B2
(45) Date of Patent: Apr. 22, 2008

(54) SYSTEM, DEVICE AND METHOD FOR VENTILATING A ROOM

(75) Inventor: Agne Nilsson, Limassol (CY)

(73) Assignee: Johnson Medical Development Pte. Ltd., Singapore (SG)

( * ) Notice: Subject to any disclaimer, the term of this patent is extended or adjusted under 35 U.S.C. 154(b) by 116 days.

(21) Appl. No.: 10/526,756

(22) PCT Filed: Sep. 4, 2003

(86) PCT No.: PCT/SE03/01372

§ 371 (c)(1),
(2), (4) Date: Mar. 4, 2005

(87) PCT Pub. No.: WO2004/021957

PCT Pub. Date: Mar. 18, 2004

(65) Prior Publication Data

US 2005/0250436 A1 Nov. 10, 2005

(30) Foreign Application Priority Data

Sep. 4, 2002 (SE) ..... 0202618

(51) Int. Cl.
*A61G 10/02* (2006.01)
*F24F 13/06* (2006.01)
*F24F 7/007* (2006.01)

(52) U.S. Cl. ..... 454/187; 454/284; 454/296

(58) Field of Classification Search ..... 454/187, 454/188, 189, 190, 284, 296
See application file for complete search history.

(56) References Cited

U.S. PATENT DOCUMENTS 3,380,369 A * 4/1968 Allander ..... 454/189
3,462,920 A * 8/1969 Denny ..... 55/413
3,511,162 A * 5/1970 Truhan ..... 454/187

(Continued)

FOREIGN PATENT DOCUMENTS

DE 2 260 380 6/1974

(Continued)

OTHER PUBLICATIONS

Attached English abstract for DE 2851046 A1 from Derwent Information Ltd.*

*Primary Examiner*—Steven B. McAllister
*Assistant Examiner*—Patrick F. O'Reilly, III
(74) *Attorney, Agent, or Firm*—Ladas & Parry LLP

(57) ABSTRACT

A system and method for ventilating a room in which the system has at least one air supply unit and one air exhaust unit. The air inlet unit has a guiding slot diffuser for guiding an airstream in a certain direction, such that a patient, lying down in a bed on his back, receives the airstream frontally. The exhaust unit is arranged near the floor and near a head end of the bed such that air is arranged to leave the room after having ventilated the patient. The air supply unit is also provided with a booster fan arranged in air communication with the guiding slot diffuser such that fresh air can be forced through the diffuser by the aid of the booster fan forming a first an airstream. The first airstream leaves the diffuser bringing with it a larger mass of fresh air leaving the air supply unit via perforated sheets, forming the airstream devised to cool the patient.

9 Claims, 7 Drawing Sheets

U.S. PATENT DOCUMENTS

| | | | | |
|---|---|---|---|---|
| 3,726,203 | A * | 4/1973 | Lindestrom | 454/189 |
| 3,935,803 | A | 2/1976 | Bush | |
| 4,131,059 | A | 12/1978 | Gustavsson | |
| 4,606,259 | A * | 8/1986 | Nystrom | 454/189 |
| 4,781,108 | A * | 11/1988 | Nillson | 454/187 |
| 5,054,379 | A * | 10/1991 | Sodec | 454/296 |
| 6,702,662 | B2 * | 3/2004 | Kristensson | 454/187 |
| 6,869,458 | B2 * | 3/2005 | Iijima et al. | 55/385.2 |
| 7,037,188 | B2 * | 5/2006 | Schmid et al. | 454/187 |

FOREIGN PATENT DOCUMENTS

| | | |
|---|---|---|
| DE | 28 51 046 | 6/1980 |
| SE | 513220 | 12/1998 |
| WO | WO86/06460 | 11/1986 |
| WO | WO00/32150 | 6/2000 |

* cited by examiner

SYSTEM, DEVICE AND METHOD FOR VENTILATING A ROOM

FIELD OF INVENTION

The present invention relates to air conditioning systems and particularly to devices and method for providing ventilation and air conditioning in hospitals or other places, where the need for clean air is high.

BACKGROUND

As airflow is increased in an air conditioning system, the risk of turbulence is increased and also the risk of whirling up infection agents that may infect a patient in e.g. a hospital ward. The risk is more pronounced in tropical countries, where a high cool airflow often is needed to cool the patient for the sake of comfort.

WO 86/06460 to Nilsson discloses a method and means for supplying clean air to an operating room. The means comprises a central supply member for a control carry beam directed towards said area and at two secondary air supply members adapted adjacent said central supply member for supplying secondary air beams in an area surrounding the carry beam.

U.S. Pat. No. 3,935,803 to Bush discloses an air filtration apparatus of a portable kind for directing a filtered stream of air downwardly over a hospital bed.

WO 00/32150 to Nilsson discloses a method and device for ventilation of a room with walls and ceiling comprising a sloping flow director for the air supplied arranged at an exhaust opening.

SE 513220 to Nilsson discloses a device and a method for ventilation of a room with walls and ceiling comprising exhaust openings arranged in the walls of the room.

The problem with turbulence is however not addressed and solved in so an efficient and cost effective manner in prior art as in the present invention.

SUMMARY

The present invention is based on the inventors knowledge and realisation of how air behaves, in particular in hospital wards and in operating rooms in tropical countries. It is an object of the present invention to solve the problem of keeping air velocity relatively low all the time when it travels inside a room, to prevent dust and other particles to whirl up. When the air is inside ducts or air processing units this is normally not a problem. The problem occurs when the conditioned air passes through the room.

An embodiment according to the invention solves this by providing an air supply unit with large effective air supply area and a diffuser for controlling the flow, together with an air exhaust unit with large effective air suction area, providing low exhaust air velocity.

A preferred embodiment comprises at least one air supply unit and one air exhaust unit, where said air supply unit comprises a guiding slot diffuser for guiding an airstream in a certain direction, such that a patient, lying down in said bed on his back, receives said airstream frontally, and that said exhaust unit is arranged near the floor and near a head end of the bed such that air is arranged to leave the room after having ventilated the patient. The air supply unit is also provided with a booster fan arranged in air communication with the guiding slot diffuser such that fresh air can be forced through the diffuser by the aid of said booster fan forming a first airstream, and that guiding slots are provided and aligned such that said first airstream is guided to leave the diffuser bringing with it a larger mass of fresh air leaving the air supply unit via perforated sheets forming an airstream devised to cool the patient.

The inventive concept makes it possible to control an airstream of relatively low velocity by employing the phenomena called co-ejection; i.e. an airstream or airjet co-ejects air up to ten times its original volume. By arranging a slot diffuser where slot dimensions, slot distances, and slot angles are dimensioned with regard to the booster-fan controlled airflow, a core airstream is created. The slot diffuser is arranged in the middle of a main diffuser. Said airstream secures the flow and direction of the co-ejected airflow from the main diffusers or the like, towards the patient and ultimately towards an optional exhaust unit. The described arrangement provides a controlled directed flow of clean air over the patient and do not, as may be the case with prior art diffusers, provide an unpredictable airflow difficult to control.

One of the objects of the present invention is to simplify and improve the ventilation for individual patients in a multiple bed ward. In a ward with more than one bed individual airflow for each patient is preferable to achieve optimal comfort and a minimised risk of spreading infections.

The invention solves this problem by providing a system comprising a main diffuser and a slot diffuser. The slot diffuser comprises at least one but preferably two slots. Each slot has a length, a width and a depth. The longitudinal axes of each slot are arranged principally parallel with a plane parallel the left or right side of the bed of the patient. Preferably, parallel with the length axes of said bed, the depth axes of each slot are arranged such that in a multiple slot system said axes point towards a common, small area, i.e. said depth axes are arranged convergent, forming an acute angle between them.

Each slot is preferably formed out of two parallel sheets of metal or another suitable material, such as plastic. Each slot is arranged to have a depth many times larger than its width. Typical dimensions include a width of 2 mm and a depth of 25 mm. The length of each slot is preferably chosen in the same magnitude as a hospital bed. A length of approximately half a bed length will probably be sufficient.

BRIEF DESCRIPTION OF THE DRAWINGS

Preferred embodiments of the present invention are described in the following text and with the aid of the enclosed figures, of which.

DETAILED DESCRIPTION OF PREFERRED EMBODIMENTS

Figure 1B:
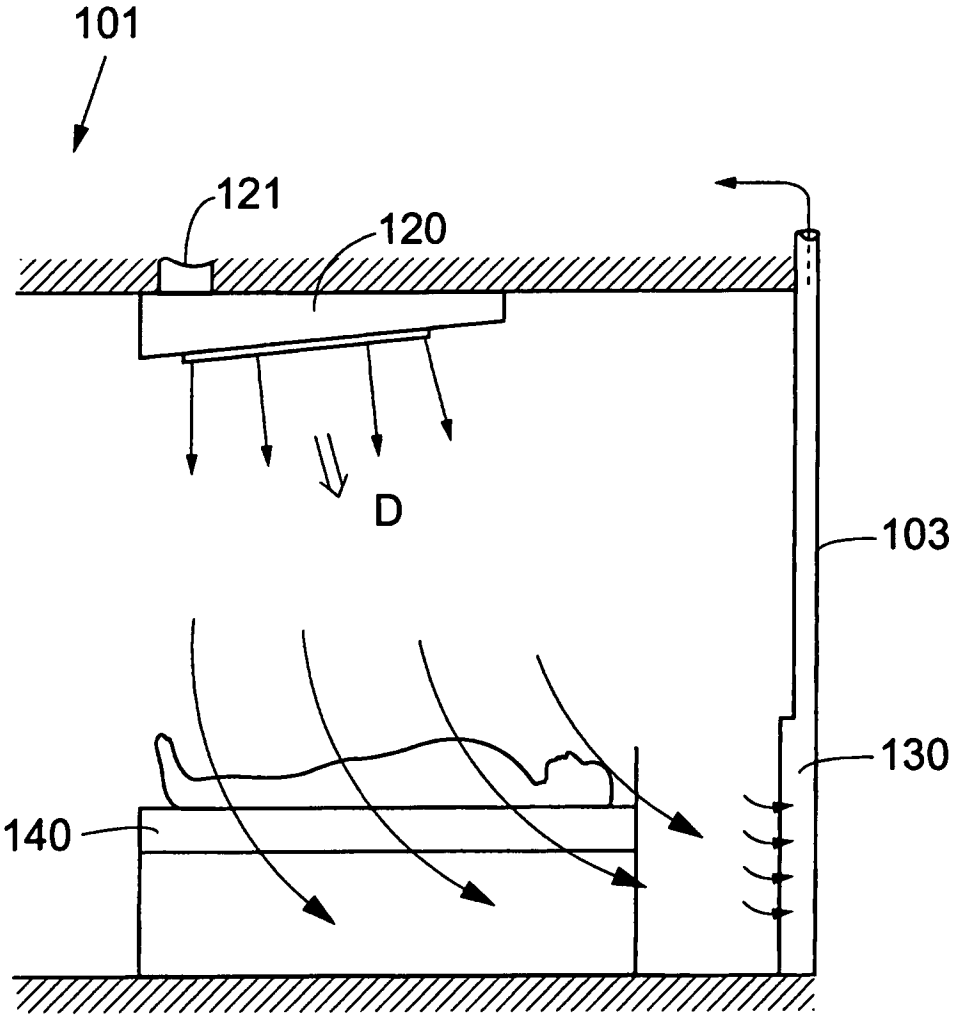
FIG. 1*b* shows the room of FIG. 1*a* in a different side view.
Figure 1A:
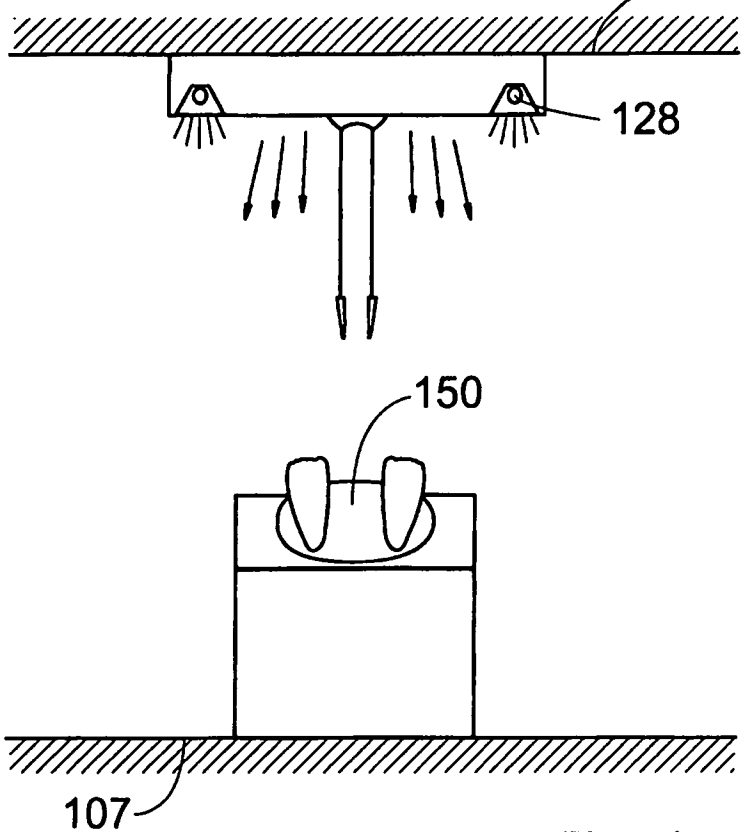
FIG. 1*a* is a side view of a room comprising a system according to one embodiment of the invention.

A preferred embodiment is shown in FIGS. 1*a* and 1*b*. A room 101 having walls 103, a ceiling 105 and a floor 107 is provided with an air conditioning system comprising at least one air supply unit 120 and at least one low velocity air exhaust unit 130. The air supply unit 120 is arranged in the ceiling 105 over a patient's bed 140 for providing conditioned air to a patient 150 being in the bed 140.

Figure 2B:
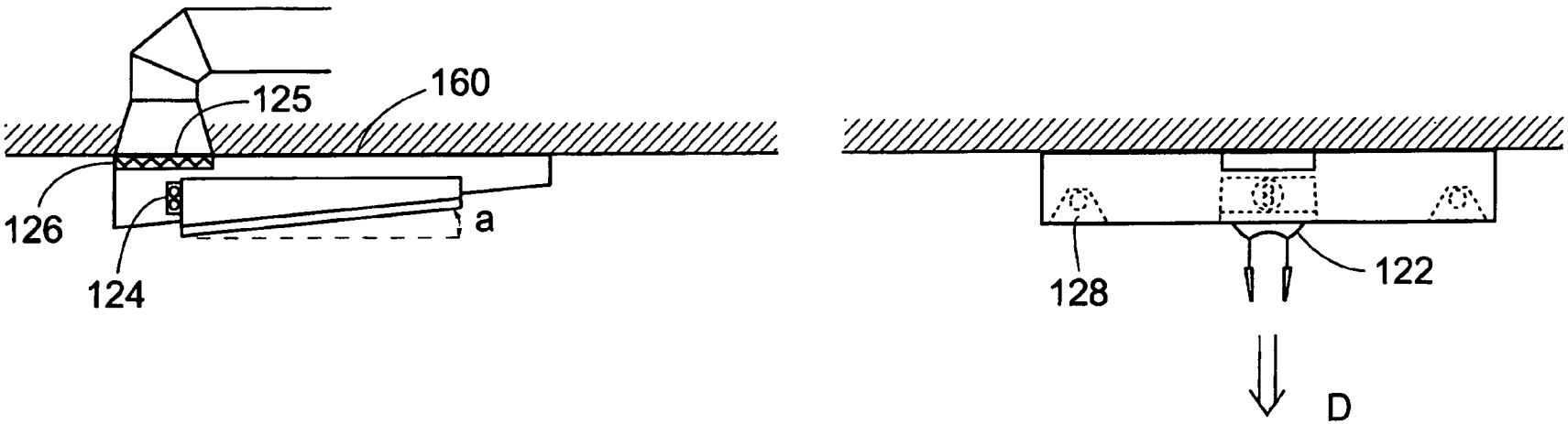
FIGS. 2*a, b* show two side views of an air supply unit and a bed.
Figure 2A:
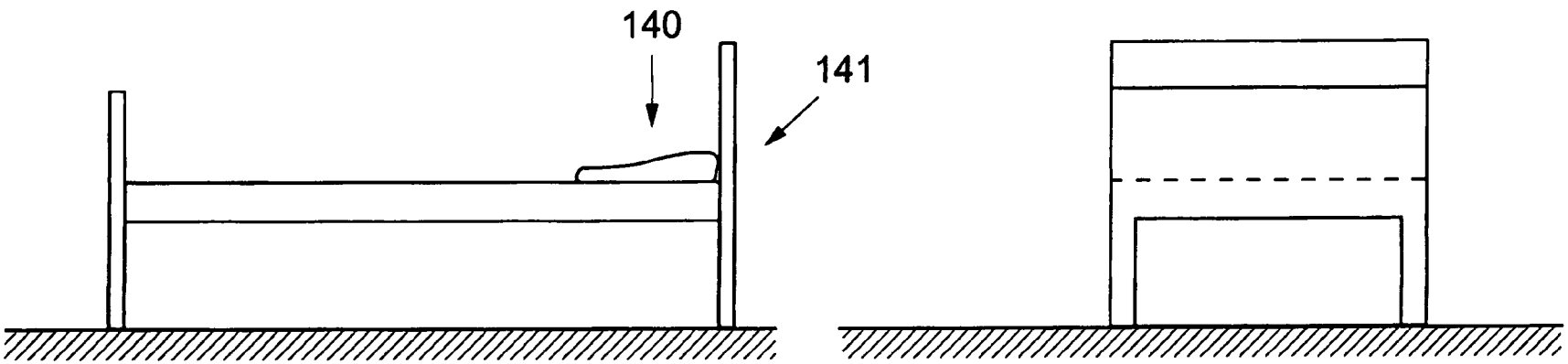

FIGS. 2*a* and 2*b* show the air supply unit 120 of the invention in greater detail. The supply unit 120 is provided with an inlet 121, a guiding slot diffuser 122, a booster fan 124 an air filter 125, an opening for replacing the filter 126, some perforated sheets and a light unit 128.

Air is supplied to the supply unit 120 from a control system. Air enters through the inlet 121, passes through the filter 125 where particles are removed. It then disperses in the inside of the supply unit 120. Part of the air enters the suction side of the booster fan 124, which fan 124 subsequently forces it out through the guiding slot diffuser 122. The rest of the air is gently forced through the perforated sheet 305, 306, best seen in FIG. 3*a*.

Because of the devised arrangement, a cooling airstream is formed outside the air supply unit comprising air being forced through the guiding slot diffuser 122, and air passing through holes of the perforated sheet 305, 306. Air in the room, from outside this cooling airstream will mix only to a very small degree with said cooling airstream, due to the above described arrangement, leaving a high degree of uncontaminated air to cool the patient.

Air from the supply unit 120 is thus flowing towards the patient, over his or her body and is then leaving the room 101 via a low velocity exhaust unit 130 arranged near the pillow end 141 of said bed 140.

Figure 3A:
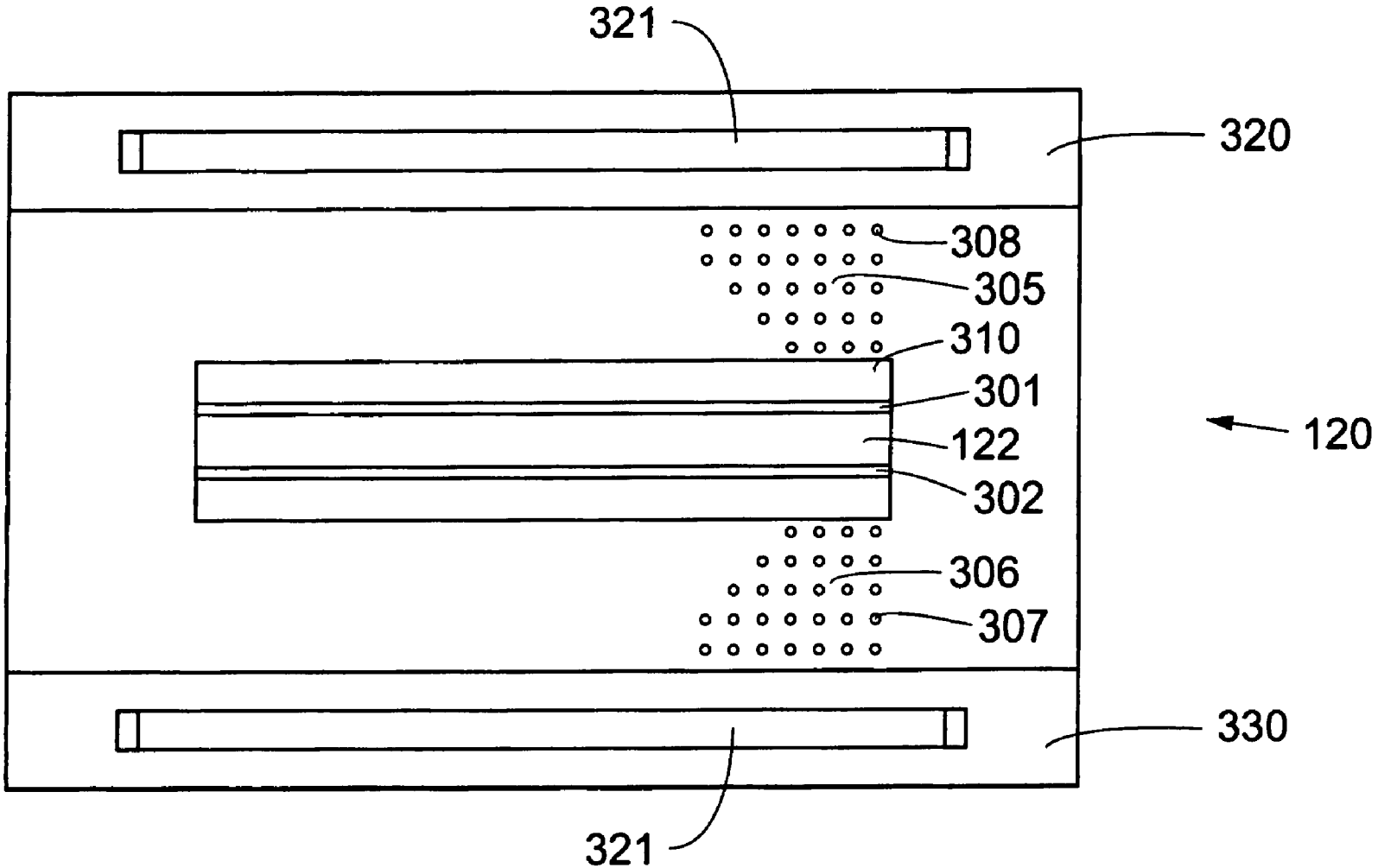
FIG. 3*a* shows a front view of an air supply unit.

FIG. 3*a* shows a front view of the air supply unit 120, The guiding slot diffuser 122 comprises an elongated frame 310 having a first 301 and a second 302 slot. The directions of the slots are preferably parallel to each other or slightly converging such that airstreaming out of them theoretically would meet a number of feet outside the diffuser. The number of slots is preferably two since one gives an airstream having to drive a lot of surrounding air, which will slow it down. Two slots give rise to two co-operating flows that will give a more stable flow that will reach longer from the diffuser. Three or more would be more expensive without adding any substantial advantages. Preferably said slots can be adjusted directionally to provide different directions of the airstream. The air supply unit also comprises perforated sheets 305, 306 arranged on at least one side of the diffuser 122, such that, when air is forced through the slot 301, 302 and air is forced through the holes 307, 308 in the perforated sheets 305, 306, an airstream is formed having a direction D as indicated in FIG. 1*a* obliquely down towards the patient. Without the diffuser 122, air would slowly trickle out and would be very easy to disturb, e.g. by personnel walking through the room.

In a preferred embodiment the air supply unit also comprises light tubes 321, and corresponding reflectors 320, 330 arranged to provide adequate lighting of the room and/or the bed 140 and the patient 150.

In a preferred embodiment the perforated sheet is arranged having approximately 30 percent of the total area being holes for letting the air through. The area of perforated sheet is preferably around 1.2 square meters, which entail 0.36 square meters of opening. With an air speed of 0.05 meters per second, this will equal a flow of 65 cubic meters per hour.

The at least one slot in the diffuser is devised having an area of 0.004 square meters. With an air speed of 2 meters per second this will give rise to a slot flow of 30 cubic meters per hour. In this example the slot diffuser flow is having a volume of less than half of the volume flow from the main diffuser.

In total, this will give rise to an airflow of 95 cubic meters per hour. In this embodiment, assuming a volume of air over the patient of approximately 2 cubic meters, the air will be changed 48 times per hour (48 ACH).

In another preferred embodiment the air supply unit comprises a guiding slot diffuser that is arranged having an angle $\alpha$ relatively to a horizontal base plane 160 of said supply unit. Said angle $\alpha$ is preferably devised such that an airstream leaving the supply unit moves in the direction D over the patient facilitating a flow of air over the patient, that at the same time flows towards the air exhaust outlet 130. The optimal value of $\alpha$ is depending on the distance between the floor 107 and the ceiling 105. In most applications, however, an angle of between 5 and 10 degrees is devised. It is realised that the base plane 160 also can be given a vertical extension. The longitudinal axis of each slot is however lying in a plane which is parallel to a side wall of the room, i.e. parallel to a wall of the room parallel to a left or right side of the bed in which the patient is lying.

Figure 3B:
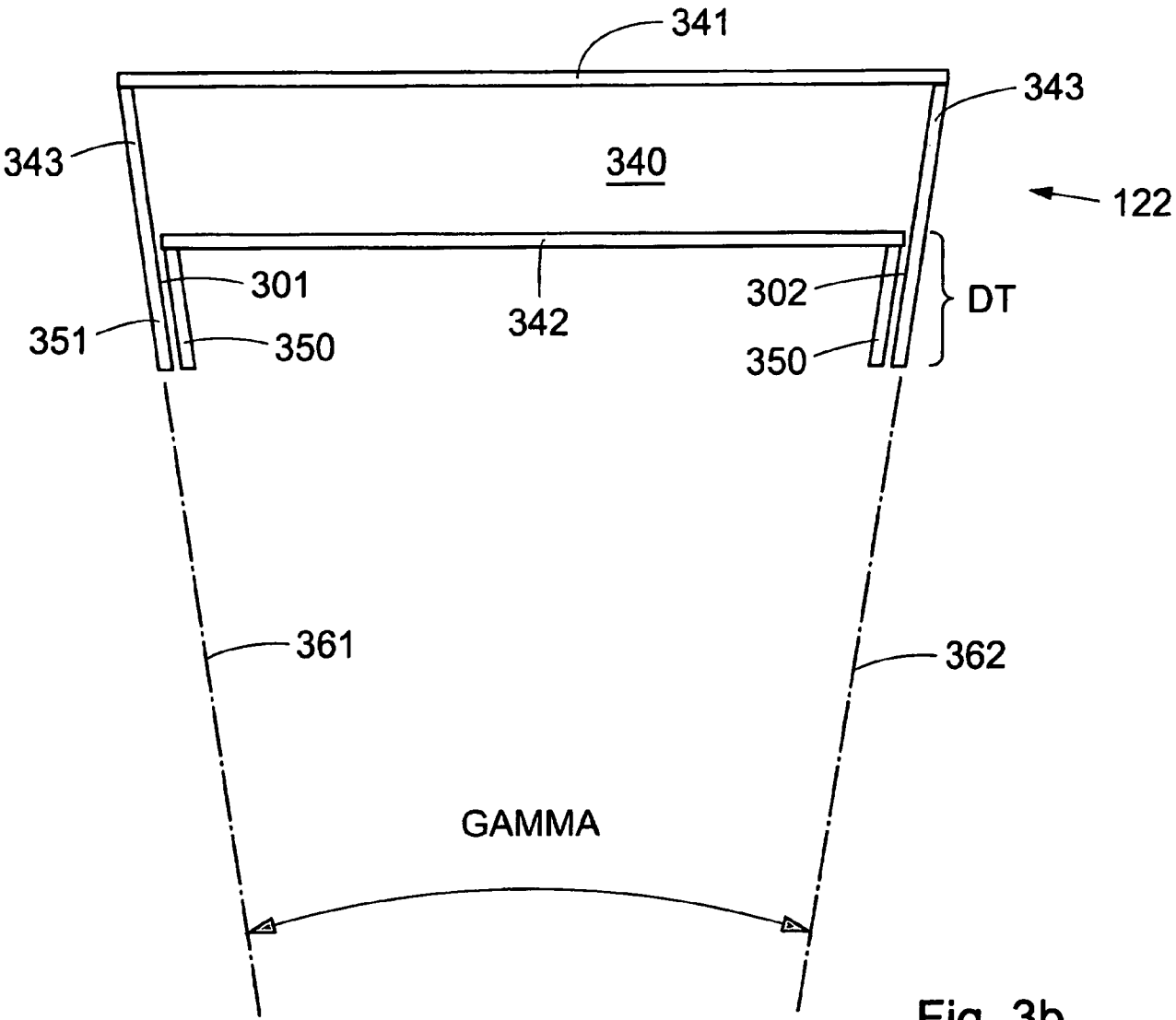
FIG. 3*b* shows a cross sectional view of a slot diffuser.

FIG. 3*b* shows a cross sectional view of the slot diffuser 122 in FIG. 3*a*. The slot diffuser 122 has an inner air-conducting space 340 confined between an upper wall 341, a lower wall 342 and side walls 343. Slots 301, 302 are formed between an excess part 351 of a side wall 343 and a slot inner side wall 350. Each slot 301, 302 has a depth DT. Each slot 301, 302 also has a width equal to the distance between the excess part 351 of the side wall 343 and the slot inner side wall 350. Each slot also has a length, not seen in FIG. 3*b*. The depth DT is arranged having a multifold larger measure than the width, i.e. the depth being 10 to 20 times greater than the width. Typical dimensions include a depth of 25 mm and a width of 2 mm. Each slot 301 302 has a depth axis direction 361, 362, The slots 301, 302, i.e. their side walls 350, 351, are arranged such that the two directions 361, 362 converge with an acute angle GAMMA. Preferably, the angle GAMMA is arranged to have a value of 10 degrees. In another embodiment the slots 301, 302 are formed between two walls 350, 351 that are adjustable relatively to each other, such that the angle GAMMA can be adjusted. By adjusting the angle it is possible to give the airstream a longer or shorter reach. It would also be possible to give the airstream a different direction.

Figure 4:
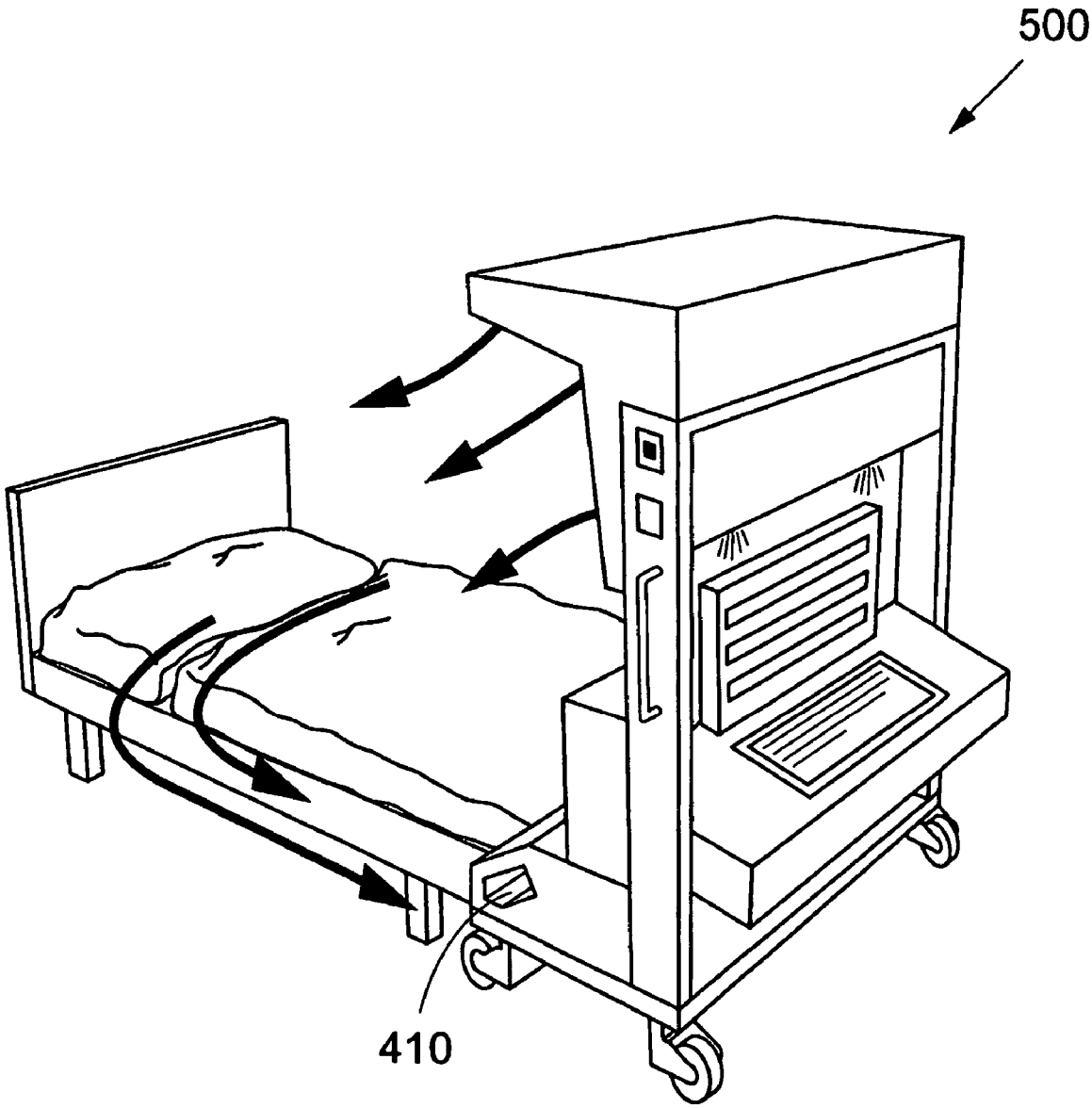
FIG. 4 shows a portable air condition unit for providing a patient in a bed with fresh air.
Figure 5A:
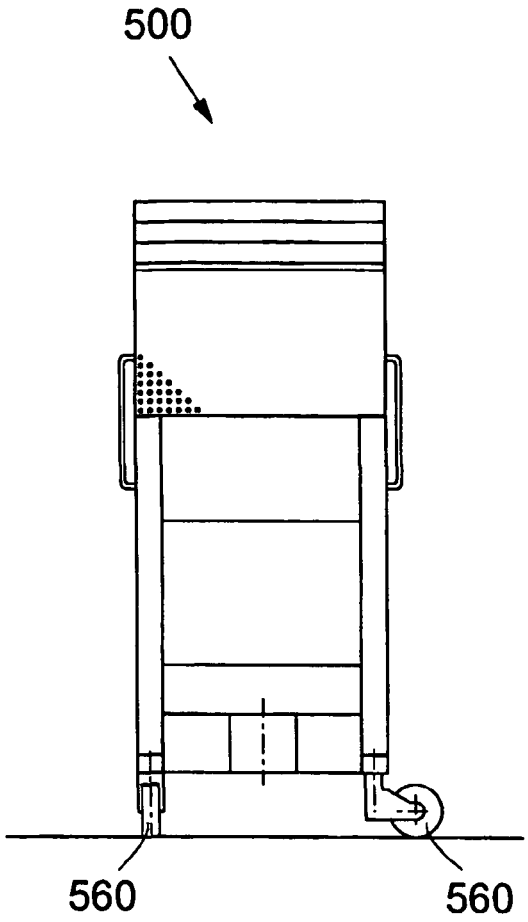
FIGS. 5*a, b, c* show front, side and top views of the unit in FIG. 4.
Figure 5B:
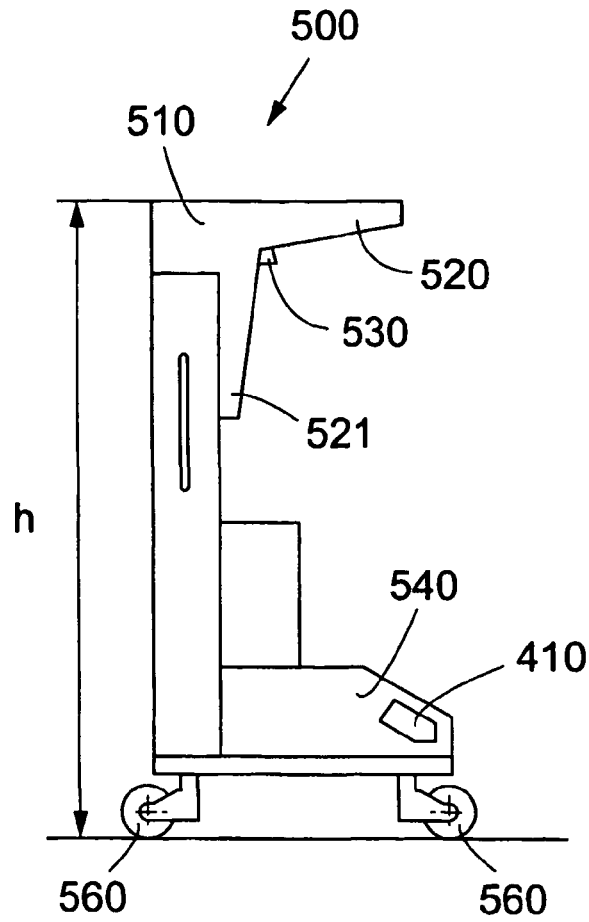
Figure 5C:
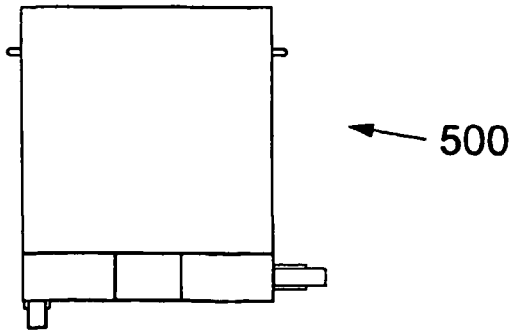
Figure 6:
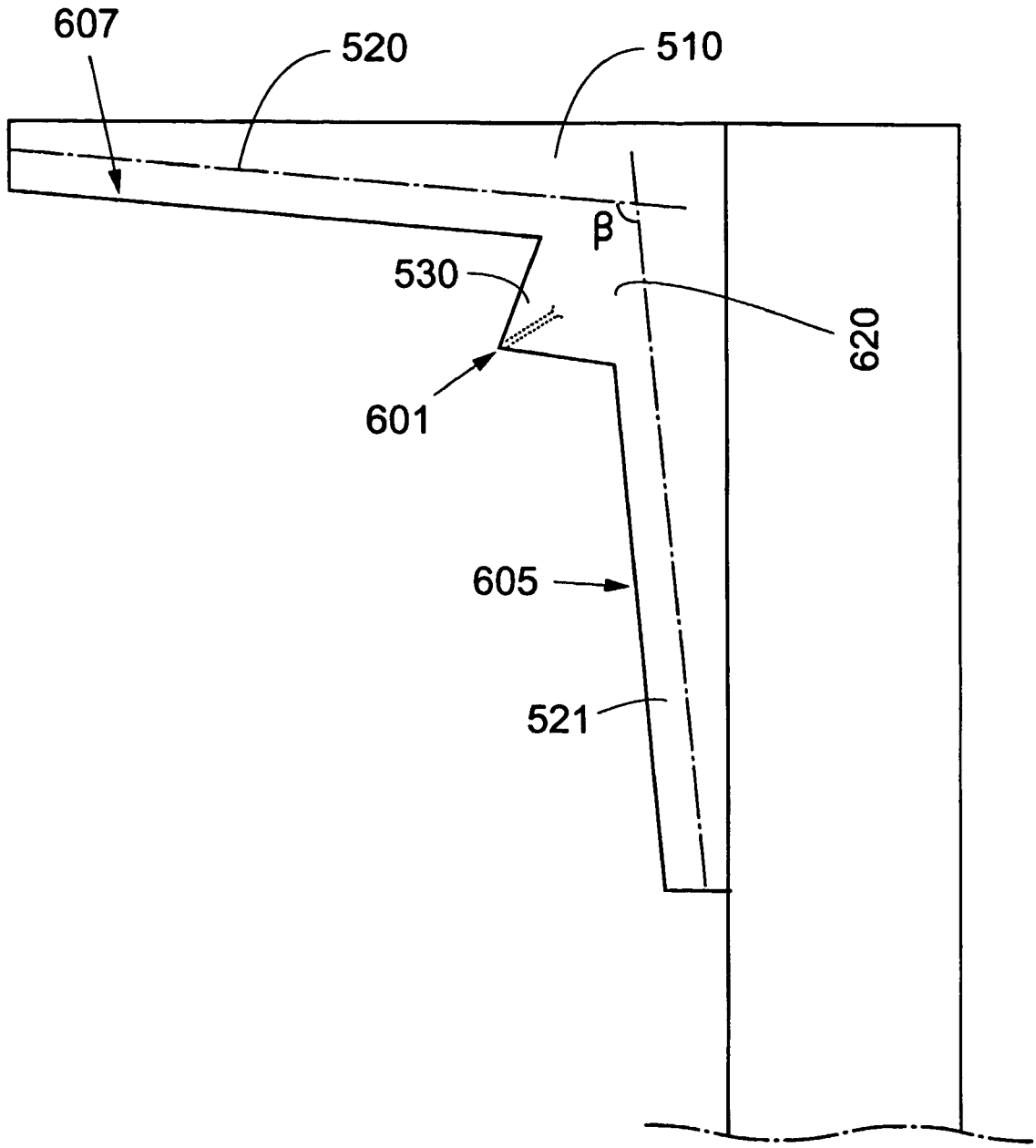
FIG. 6 shows a detail of the diffuser part of the unit in FIG. 4.

Referring to FIGS. 4, 5*a, b, c* and 6*a* portable air condition unit 500 is shown. The unit 500 comprises an air inlet 410, a diffuser 510, having main diffusers 520, 521 arranged with an angle $\beta$ between them and a slot diffuser 530. Said angle $\beta$ is preferably between 80 and 120 degrees. In an advantageous embodiment said angle $\beta$ is approximately 99 degrees. The unit is provided with a fan and power supply unit 540 and wheels 560, such that said air conditioning unit 500 can be moved from one place to another, and e.g. provide conditioned air to the patient having most need for cool air at the moment.

In a preferred embodiment the slot diffuser 530 comprises a slot, preferably 2 mm wide, arranged between the main diffusers 520, 521, providing an air passing area of approximately 0.14 square decimetres. The two main diffusers 520, 521 comprise perforated sheet 605, 607 approximately 400×

700 mm with 30% holes providing an air passing area approximately 8.4 square decimetres each. Total air passing area approximately 0.17 square meters.

An air speed of 0.2 m/s will provide an amount of air of 122 cubic metres per hour and approximately 61 air changes per hour. The air speed in column: 1.7 m/s.

In an advantageous embodiment the slot diffuser 530 is arranged at a meeting corner 620 of two main diffusers 520, 521.

The invention claimed is:

1. An air supply unit for providing conditioned air to a patient lying in a bed, comprising: a booster fan, arranged to force air through a guiding slot diffuser for guiding an airstream in a certain direction, said diffuser having two slots, and one area of perforated sheet, being arranged at an outlet side of said diffuser, where the area of perforated sheet is arranged in close proximity of the slots such that an airstream of air passing through both of the perforated sheet and the diffuser slots assumes a direction as controlled by the direction of the diffuser slots, and the diffuser slots form an angle $\alpha$ to a base plane of said supply unit such that air is guided obliquely down towards the patient, and wherein the at least two slots of the slot diffuser are arranged proximate to each other, and two main diffusers are provided and are arranged with the two main diffusers separately and opposingly disposed at two sides of the proximately arranged slot diffusers, and wherein each slot has a length, a width and a depth, wherein the depth is substantially larger than the width, and wherein the depth is ten to twenty times larger than the width and, wherein the width is approximately 2 mm.

2. An air supply unit as recited in claim 1, wherein said base plane is arranged horizontal.

3. An air supply unit as recited in claim 2, wherein said angle $\alpha$ is between 5 and 16 degrees.

4. An air supply unit as recited in claim 3, wherein said diffuser slots are adjustable sideways to enable setting the direction of the airstream.

5. An air supply unit as recited in claim 4, wherein an angle (GAMMA) is formed between the depth axes of each slot, and the angle (GAMMA) is acute.

6. An air supply unit as recited in claim 5, wherein the angle (GAMMA) between the depth axes is arranged to be adjustable.

7. An air supply unit as recited in claim 5, wherein the angle (GAMMA) between the depth axes is arranged to be 10 degrees.

8. An air supply unit as recited in claim 1, further comprising light tubes and corresponding reflectors for providing adequate lighting to a bed area of the room.

9. A method for supplying fresh air to a patient lying in a bed in a room comprising the following steps:

providing a first, relatively fast flow of air, relatively small in volume;

providing a second, relatively slow flow of air, relatively large in volume, and adjacent to the first flow of air such that said first flow of air co-ejects air from the second flow;

providing a low speed large volume suction for evacuating the supplied air;

providing the first flow of air by forcing air through two elongated slots having converging axes of depth;

providing the first flow of air by forcing air parallel to a vertical plane parallel to a side of said bed;

providing the second flow of air by forcing air through a perforated sheet of metal or similar material having a hole content of approximately 30%; and providing the second flow of air with an air speed of less than 5% of the air speed of the first flow and with volume flow of more than double the volume flow of the first flow.

* * * * *